US009982580B2

(12) United States Patent
Staley et al.

(10) Patent No.: US 9,982,580 B2
(45) Date of Patent: May 29, 2018

(54) ADAPTATION OF A WIRELESS OIL LEVEL SENSOR TO AN OIL PAN DRAIN PLUG

(71) Applicant: GM Global Technology Operations LLC, Detroit, MI (US)

(72) Inventors: David R. Staley, Flushing, MI (US); Roxann M. Bittner, Bloomfield Hills, MI (US); Eric W. Schneider, Shelby Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 57 days.

(21) Appl. No.: 15/008,777

(22) Filed: Jan. 28, 2016

(65) Prior Publication Data

US 2016/0290191 A1 Oct. 6, 2016

Related U.S. Application Data

(60) Provisional application No. 62/139,849, filed on Mar. 30, 2015.

(51) Int. Cl.

| | |
|---|---|
| ***F01M 1/02*** | (2006.01) |
| ***F01M 11/04*** | (2006.01) |
| ***F01M 11/00*** | (2006.01) |
| ***F01M 11/12*** | (2006.01) |

(52) U.S. Cl.

CPC ..... *F01M 11/0408* (2013.01); *F01M 11/0004* (2013.01); *F01M 11/12* (2013.01); *F01M 2011/0441* (2013.01)

(58) Field of Classification Search

CPC ..... F01M 2011/0416; G01N 33/2888; F16N 2250/00; F16N 2250/04; F16N 2250/18; G01F 23/14

USPC ..... 123/196 R; 184/1.5; 251/144; 73/53.05

See application file for complete search history.

(56) References Cited

U.S. PATENT DOCUMENTS 1,835,020 A * 12/1931 De Forest ..... F16K 43/008 251/211
4,304,132 A * 12/1981 Snaper ..... F02D 33/003 340/620
4,905,643 A * 3/1990 DeGrazia, Jr. ..... F01M 11/0408 123/196 S
5,368,181 A * 11/1994 Myers ..... B65D 47/263 141/65

(Continued)

FOREIGN PATENT DOCUMENTS

CN 203978834 U 12/2014

*Primary Examiner* — Marguerite McMahon
*Assistant Examiner* — James Kim
(74) *Attorney, Agent, or Firm* — Harness, Dickey & Pierce, P.L.C.

(57) ABSTRACT

An oil drain plug and wireless oil level sensor assembly is provided including an oil drain plug having a shaft and a head, the shaft having external threads and an axial passage extending axially therein in communication with at least one radial passage extending through the shaft from the axial passage to an exterior of the shaft. An oil level sensor includes a housing having an annular mounting portion defining an aperture extending there through for receiving the shaft of the oil drain plug. A pressure transducer is in fluid communication with the aperture and connected to a circuit and a battery disposed within the housing that provide wireless signals representative of the oil level.

18 Claims, 3 Drawing Sheets

(56) References Cited

U.S. PATENT DOCUMENTS

| | | | | | |
|---|---|---|---|---|---|
| 5,465,811 | A * | 11/1995 | Katz | F16F 9/0236 | 184/24 |
| 5,687,687 | A * | 11/1997 | Trueblood | F01M 11/12 | 123/196 S |
| 6,058,898 | A * | 5/2000 | Freese | F01M 11/0004 | 123/195 C |
| 6,553,812 | B2 * | 4/2003 | Park | G01N 11/08 | 324/663 |
| 7,521,945 | B2 * | 4/2009 | Hedges | G01N 33/2888 | 324/698 |
| 9,020,766 | B2 | 4/2015 | Von Herzen et al. | | |
| 9,651,538 | B2 * | 5/2017 | Von Herzen | G01N 33/2888 | |
| 9,700,827 | B2 * | 7/2017 | Magno, Jr. | B01D 49/00 | |
| 2006/0230833 | A1 * | 10/2006 | Liu | B01D 35/143 | 73/649 |
| 2008/0173088 | A1 * | 7/2008 | Quill | F04B 51/00 | 73/323 |
| 2009/0050043 | A1 * | 2/2009 | Alvarez | B63B 13/00 | 114/197 |
| 2010/0126251 | A1 | 5/2010 | Pileggi et al. | | |
| 2014/0116808 | A1 * | 5/2014 | Kile | F16N 19/003 | 184/108 |
| 2014/0266065 | A1 * | 9/2014 | Von Herzen | G01N 33/2888 | 320/137 |
| 2016/0037238 | A1 * | 2/2016 | Salvador | H04Q 9/00 | 340/870.09 |

* cited by examiner

ADAPTATION OF A WIRELESS OIL LEVEL SENSOR TO AN OIL PAN DRAIN PLUG

CROSS-REFERENCE TO RELATED APPLICATIONS

This application claims the benefit of U.S. Provisional Application No. 62/139,849, filed Mar. 30, 2015. The entire disclosure of the above application is incorporated herein by reference.

FIELD

The present disclosure relates to a wireless oil level sensor for an internal combustion engine.

BACKGROUND AND SUMMARY

This section provides background information related to the present disclosure which is not necessarily prior art.

It is important to maintain a proper amount of oil in an engine in order for the engine to be properly lubricated. Typically, engines are equipped with a dipstick that is manually removed from an engine in order to observe the oil level of the oil on the dipstick. Although the oil dipstick is a reliable method of detecting the oil level, it requires that the vehicle operator open the vehicle hood and pull the dipstick out of the engine. Optional engine oil switches exist that notify an operator that the oil level is low. These oil switches have to be wired into the vehicle and fixedly mounted within the oil pan at a level representative of a minimum level at which the user needs to be notified of the low oil condition. Therefore, the typical oil level sensor is only useful for providing a low oil indicator when a low oil condition exists.

The present disclosure provides implementation of a wireless oil level sensor mounted to an oil plug of an engine. The oil pressure sensor detects a pressure which can then be used to determine a volume or level of oil above the sensor. The sensor pressure reading can be associated with an oil level that can then be transmitted to a vehicle control unit. The oil pressure sensor is designed to be isolated from the heated oil within the oil pan, and is mounted external to the oil pan while communicating with the oil through a passage in the oil drain plug.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Figure 1:
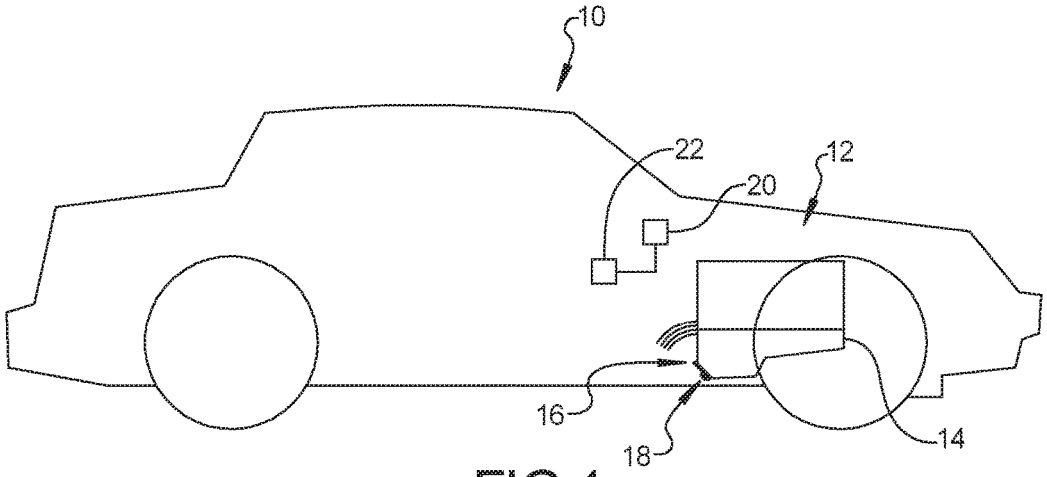
FIG. 1 is a schematic view of a vehicle having an engine with a wireless oil sensor disposed on the oil drain plug according to the principles of the present disclosure.
Figure 2:
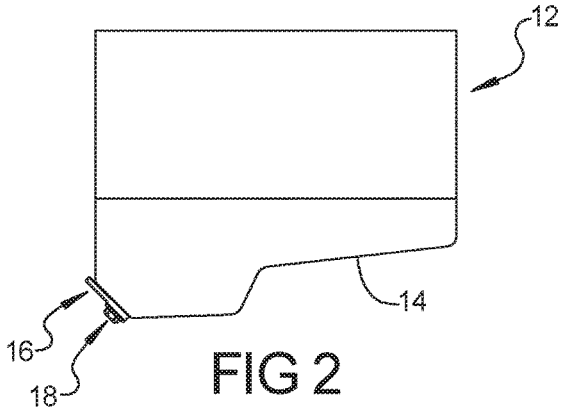
FIG. 2 is a schematic view of an engine with the wireless oil sensor disposed on the oil drain plug according to the principles of the present disclosure.

With reference to FIG. 1, a vehicle 10 is shown including an engine 12 having an oil pan 14 with a wireless oil sensor 16 mounted on an oil plug 18. The oil sensor 16 can provide wireless signals to the vehicle central processor unit 20 which can display information to the vehicle operator via a vehicle display unit 22. FIG. 2 shows a larger more detailed view of the engine oil pan 14 with the oil sensor 16 disposed on the oil drain plug 18.

Figure 3:
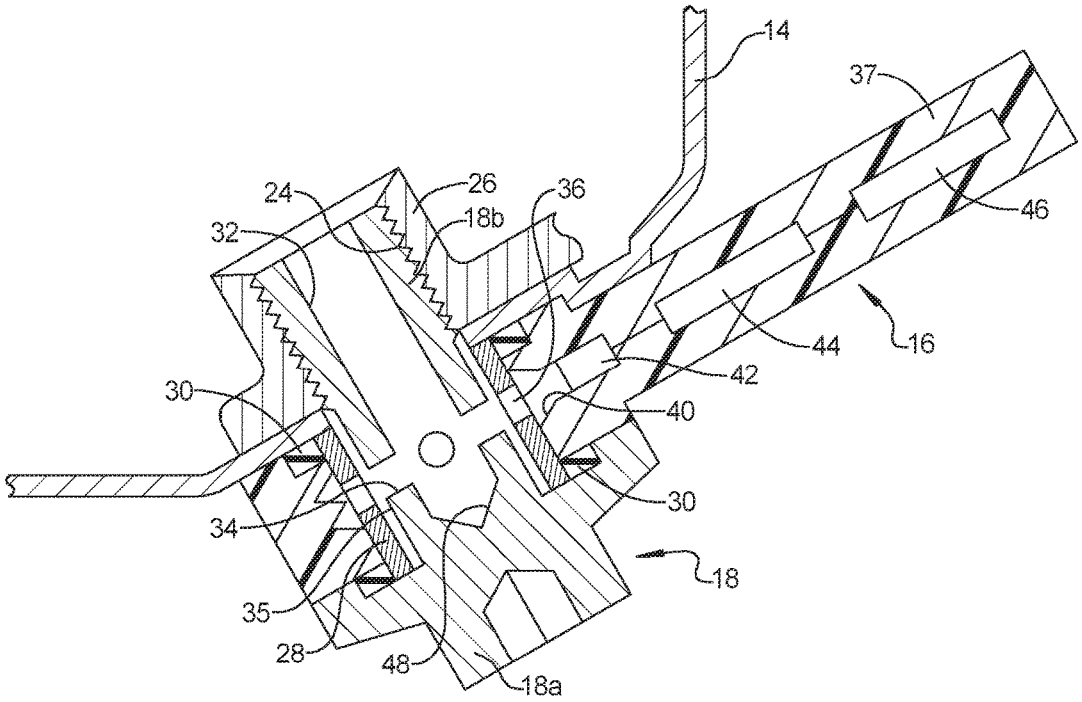
FIG. 3 is a cross sectional view of the wireless oil sensor and oil drain plug assembly received in the oil pan.
Figure 4:
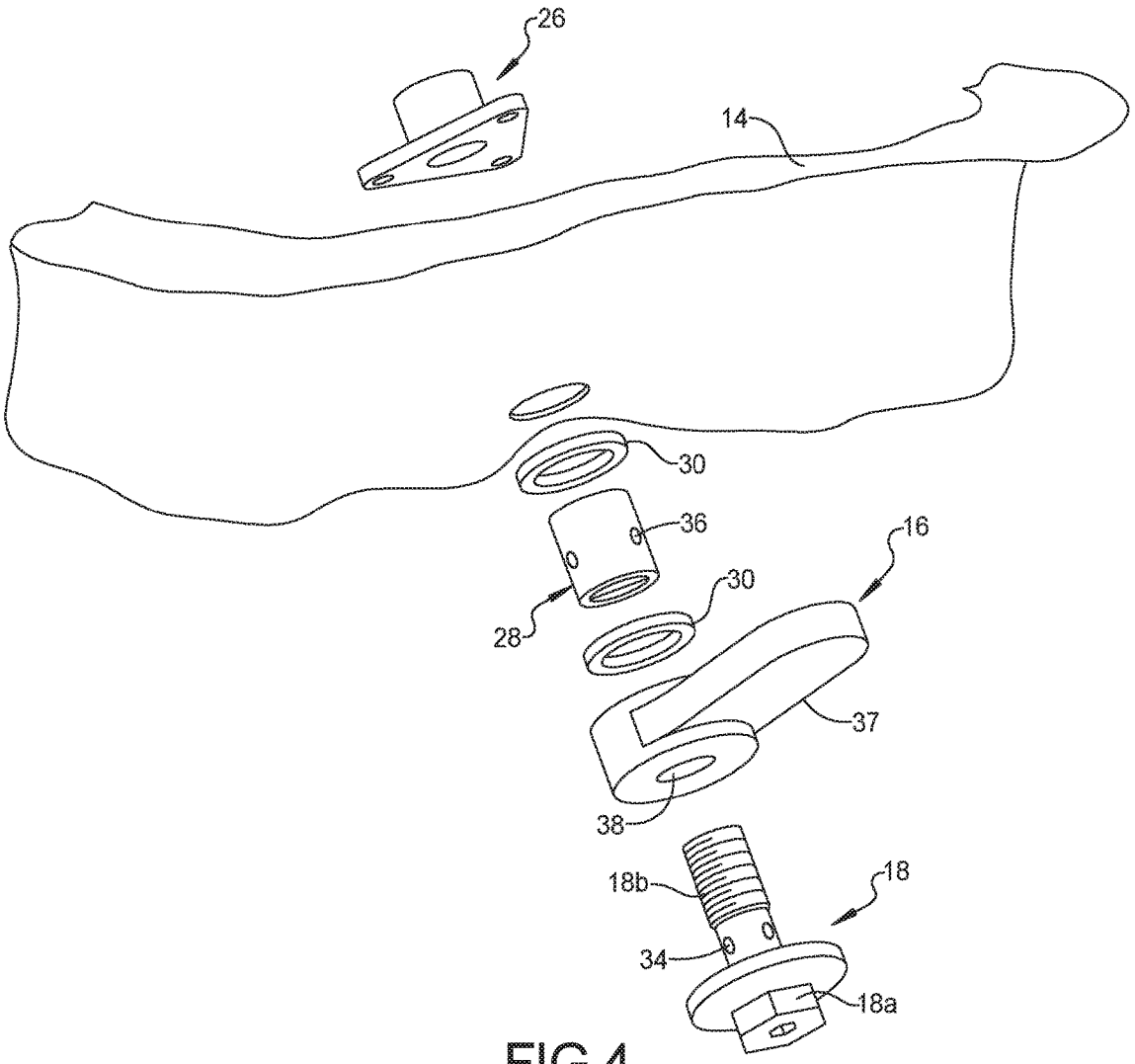
FIG. 4 is an exploded perspective view of the wireless oil sensor and drain plug assembly according to the principles of the present disclosure.

With reference to FIGS. 3 and 4, the wireless oil sensor 16 and oil pan drain plug 18 assembly is adapted to be disposed in a threaded opening 24 provided within an insert 26 in the bottom of the oil pan 14. The wireless oil sensor 16 is received on a spacer bushing 28 and a pair of seals 30 can be disposed on opposite sides of the wireless oil sensor 16.

The oil drain plug 18 includes a head 18*a* and a shaft 18*b* having external threads disposed thereon and a passage 32 extending axially therein and communicating with one or more radial passages 34. The shaft 18*b* of the oil drain plug 18 includes an annular recess disposed within the spacer bushing 28 so as to define an annular space 35 between the shaft 18*b* and the spacer bushing 28. The annular space 35 can be tuned to help isolate the sensor 16 from transient pressure conditions due to the crankcase variation or oil slosh due to vehicle dynamics. The radial passages 34 can communicate with one or more radial passages 36 extending through the spacer bushing 28. The wireless oil sensor 16 includes a housing 37 defining an annular mounting portion 37*a* having an aperture 38 extending there through that receives the spacer bushing 28. The aperture 38 includes a recess portion 40 that can define an annular groove that communicates with a pressure transducer 42. The pressure transducer 42 is connected to a circuit 44 and battery 46 that provide wireless signals representative of the pressure level and/or oil level as determined by the pressure transducer 42 and circuit 44. The circuit 44 and battery 46 are sealed within a portion 37*b* of the housing 37 that extends away from the annular mounting portion 37*a*. The wireless oil sensor 16 supports the circuit 44 and battery 46 external to the oil pan 14 so that the components thereof are not exposed to the high temperature levels within the oil pan 14. The circuit 44 and battery 46 can be sealed within the housing 37. Additional cooling features such as a heat sink, cooling fins, vent holes and other cooling measures can be utilized to aid the cooling of the circuit 44 and battery 46.

The pressure level detected by the pressure transducer 42 is subject to the pressure of oil column above the transducer 42 so that the pressure can be correlated to a volume of oil within the oil pan 14. The upper surface of the insert 26 can be disposed above a lower-most surface of the oil pan 14 so as to isolate the sensor 16 from the intrusion of water and sediment that collects in the bottom of the oil pan 14. In particular, it is desirable that the upper surface of the insert 26 is at least 4 mm above the bottom surface of the oil pan 14. It is further noted that the orientation of the transducer 42 at a level above the radial passage 34 can trap an air bubble within the cavity receiving the transducer 42 to further isolate the transducer from water and sediment. The passage 32 in the drain plug 18 can also define an extension portion 48 that can receive sediment to isolate the sediment from the transducer 42.

According to the present disclosure, the wireless oil level sensor 16 is mounted to the oil pan 14 without requiring modification to the oil pan 14 while also minimizing exposure of the sensor to the hot oil environment. The wireless oil level sensor 16 uses static pressure-based measurement technology that is exposed to the oil pressure through a passage in the modified drain plug 18. The wireless oil sensor 16 is clamped between the drain plug head and the oil pan 14 on an exterior side thereof.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An assembly for installation in an oil pan, comprising:

an oil drain plug having a shaft and a head, the shaft having a proximal end adjacent to the head and a distal end axially spaced from the head, the shaft having external threads adapted for threadedly engaging internal threads in the oil pan and extending generally from the distal end to an unthreaded region along the shaft adjacent to the head and an axial passage extending axially from the distal end of the shaft and in communication with at least one radial passage extending through the shaft from the axial passage to an exterior of the unthreaded region of the shaft that is adapted to be exterior to the oil pan; and an oil level sensor having a housing having an annular mounting portion defining an aperture extending there through for receiving the shaft of the oil drain plug and surrounding the shaft at the at least one radial passage at a location exterior to the oil pan, a pressure transducer in fluid communication with the aperture and connected to a circuit and a battery disposed within the housing that provide wireless signals representative of the oil level.

2. The assembly according to claim 1, further comprising a spacer bushing disposed between the shaft of the oil drain plug and the annular mounting portion of the oil level sensor housing within the aperture, the spacer bushing having at least one radial passage there through.

3. The assembly according to claim 2, wherein an annular space is disposed between the shaft of the oil drain plug and the spacer bushing.

4. The assembly according to claim 1, further comprising a first annular seal disposed between the head of the oil drain plug and the housing of the oil level sensor.

5. The assembly according to claim 1, wherein the circuit and battery are disposed in a portion of the housing that extends away from the annular mounting portion.

6. The assembly according to claim 1, wherein a closed end of the axial passage extends beyond the at least one radial passage of the oil drain plug.

7. An oil pan assembly, comprising:

an oil pan having an internally threaded drain hole;

an oil drain plug having a shaft and a head, the shaft having a proximal end adjacent to the head and a distal end axially spaced from the head, the shaft having external threads extending generally from the distal end to an unthreaded region along the shaft adjacent to the head, the external threads engage with the internally threaded drain hole and an axial passage extending axially from the distal end of the shaft and in communication with at least one radial passage extending through the shaft from the axial passage to an exterior of the unthreaded region of the shaft that is exterior to the oil pan; and an oil level sensor having a housing having an annular mounting portion defining an aperture extending there through for receiving the shaft of the oil drain plug and surrounding the shaft at the at least one radial passage at a location exterior to the oil pan, a pressure transducer in fluid communication with the aperture and connected to a circuit and a battery disposed within the housing that provide wireless signals representative of the oil level.

8. The oil pan assembly according to claim 7, further comprising a spacer bushing disposed between the shaft of the oil drain plug and the annular mounting portion of the oil level sensor housing within the aperture, the spacer bushing having at least one radial passage there through.

9. The oil pan assembly according to claim 8, wherein an annular space is disposed between the shaft of the oil drain plug and the spacer bushing.

10. The oil pan assembly according to claim 7, further comprising a first annular seal disposed between the head of the oil drain plug and the housing of the oil level sensor.

11. The oil pan assembly according to claim 7, wherein the circuit and battery are disposed in a portion of the housing that extends away from the annular mounting portion.

12. The oil pan assembly according to claim 7, wherein a closed end of the axial passage extends beyond the at least one radial passage of the oil drain plug.

13. An internal combustion engine, comprising:

an engine block defining a plurality of cylinders;

a plurality of pistons disposed in the plurality of cylinders and drivingly connected to a crankshaft;

an oil pan mounted to the engine block and having an internally threaded drain hole;

an oil drain plug having a shaft and a head, the shaft having a proximal end adjacent to the head and a distal end axially spaced from the head, the shaft having external threads extending generally from the distal end to an unthreaded region along the shaft adjacent to the head, the external threads engage with the internally threaded drain hole and an axial passage extending axially from the distal end of the shaft and in communication with at least one radial passage extending through the shaft from the axial passage to an exterior of the unthreaded region of the shaft that is exterior to the oil pan; and an oil level sensor having a housing having an annular mounting portion defining an aperture extending there through for receiving the shaft of the oil drain plug and surrounding the shaft at the at least one radial passage at a location exterior to the oil pan, a pressure transducer in fluid communication with the aperture and connected to a circuit and a battery disposed within the housing that provide wireless signals representative of the oil level.

14. The internal combustion engine according to claim 13, further comprising a spacer bushing disposed between the shaft of the oil drain plug and the annular mounting portion of the oil level sensor housing within the aperture, the spacer bushing having at least one radial passage there through.

15. The internal combustion engine according to claim 14, wherein an annular space is disposed between the shaft of the oil drain plug and the spacer bushing.

16. The internal combustion engine according to claim 13, further comprising a first annular seal disposed between the head of the oil drain plug and the housing of the oil level sensor.

17. The internal combustion engine according to claim 13, wherein the circuit and battery are disposed in a portion of the housing that extends away from the annular mounting portion.

18. The internal combustion engine according to claim 13, wherein a closed end of the axial passage extends beyond the at least one radial passage of the oil drain plug.

* * * * *